US005961213A

United States Patent [19]

Tsuyuki et al.

[11] Patent Number: 5,961,213

[45] **Date of Patent: *Oct. 5, 1999**

[54] STIRRING APPARATUS USING MAGNETICALLY COUPLED STIRRING IMPELLERS

[75] Inventors: Isao Tsuyuki; Yoichi Hosoya, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,898

[22] Filed: Aug. 6, 1997

[30] Foreign Application Priority Data

Aug. 6, 1996 [JP] Japan ..... 8-207219

[51] Int. Cl.[6] ..... B01F 13/08

[52] U.S. Cl. ..... 366/273

[58] Field of Search ..... 366/64–66, 96, 366/97, 102–104, 262, 263, 265, 270, 273, 274, 290–292, 314; 416/3

[56] References Cited

U.S. PATENT DOCUMENTS

| | | | |
|---|---|---|---|
| 2,581,414 | 1/1952 | Hochberg . | |
| 3,694,341 | 9/1972 | Luck, Jr. | 366/273 X |
| 3,730,488 | 5/1973 | Gardner, Jr. | 366/273 X |
| 4,534,656 | 8/1985 | De Bruyne | 366/273 X |
| 4,836,826 | 6/1989 | Carter | 366/274 X |

FOREIGN PATENT DOCUMENTS

| | | | |
|---|---|---|---|
| 3-289965 | 12/1991 | Japan | 366/274 |

*Primary Examiner*—Charles E. Cooley
*Attorney, Agent, or Firm*—Sughrue, Mion, Zinn, Macpeak & Seas, PLLC

[57] ABSTRACT

A stirring apparatus for increasing processing speed and preventing deterioration of processing quality, includes a vessel having a predetermined number of liquid supply ports into which liquid to be stirred is made to flow; a liquid exhaust port from which liquid is discharged after stirring; stirring impellers separately arranged at two positions opposed to each other in the vessel, the stirring impellers being rotated in directions opposite to each other such that the liquid in the vessel is stirred; external magnets arranged outside the walls of the vessel close to the stirring impellers, the external magnets having magnetic couplings having no shafts which penetrate the vessel and connect with the stirring impellers; and external motors arranged outside the vessel, for driving the external magnets such that the magnets rotate the stirring impellers.

4 Claims, 8 Drawing Sheets

STIRRING APPARATUS USING MAGNETICALLY COUPLED STIRRING IMPELLERS

BACKGROUND OF THE INVENTION

The present invention relates to a stirring apparatus suitable for mixing and stirring liquid continuously. More particularly, the present invention relates to improvements in a stirring apparatus, the processing speed of which is increased and the processing quality of which is enhanced when mixing and stirring are sufficiently conducted so as to obtain fine particles of uniform particle size.

FIG. 4 is a sectional view showing a conventional example of an apparatus for continuous operation capable of mixing and stirring liquid continuously while liquid is being supplied, which was available through Sinmaru Enterprises Co., and was produced by Willy A. Bachstex Co.

In FIG. 4, the apparatus comprises a substantially cylindrical vessel 2 and a plurality of stirring impellers 3 rotated in the vessel 2.

The vessel 2 is a substantially closed container, at one end of which a liquid supply port 4, into which liquid to be stirred is made to flow, is provided, and at the other end of which a liquid discharge port 5, from which stirred liquid is discharged, is provided.

There are provided a plurality of stirring impellers 3, which are fixed onto a sleeve 7 engaged with a rotational shaft 6 penetrating through the other end wall of the vessel 2. The plurality of stirring impellers 3 are rotated integrally with the rotational shaft 6 via the sleeve 7, so that liquid can be stirred in the vessel 2. The rotational shaft 6 is driven and rotated by a motor not illustrated in the drawing.

According to the above arrangement, liquid is supplied from the supplied liquid supply port 4 into the vessel 2. Then the liquid is stirred when the stirring impellers 3 are rotated, and then discharged from the liquid discharge port 5. Therefore, it is possible to conduct stirring continuously. This apparatus is disclosed in U.S. Pat. No. 2,581,414.

However, according to the above arrangement of the conventional apparatus, the following problems may be encountered. Since all stirring impellers 3 are rotated in the same direction, liquid in the stirring tank tends to flow in a steady state. Accordingly, when the rotational shaft 6 is rotated at higher speed so as to increase the processing speed of the stirrer, cavities are generated around the sleeve 7 which is located at the center of the vessel 2. Due to the foregoing, there is a remarkable tendency that the liquid to be mixed and stirred is pushed against the inner circumferential surface of the vessel 2. As a result, the liquid flows along the inner circumferential surface of the vessel 2 without being sufficiently stirred. Accordingly, quality of the processed liquid is deteriorated. For the above reasons, it is difficult to increase the processing speed.

In a portion on the end wall of the vessel 2 where the rotational shaft 6 penetrates, that is, in a shaft penetrating portion, it is necessary to provide a sealing property for preventing liquid from leaking outside the vessel, and also it is necessary to provide a lubricating property required when the rotational shaft 6 is rotated at high speed. In order to satisfy both the necessary properties, liquid seal is usually adopted for the sealing means. However, it is very difficult to maintain the liquid seal in an ideal condition. In some cases, lubricant (sealing liquid) used as a liquid seal is mixed into the vessel 2 as impurities, which deteriorates the quality of the processed liquid.

In the case where the liquid to be stirred is used as a lubricant, it is necessary to clean the lubricant, which is very difficult.

SUMMARY OF THE INVENTION

The present invention has been achieved to solve the above problems of the conventional stirrer. It is an object of the present invention to provide a stirrer characterized in that: the processing speed is increased by increasing the rotational speed of the stirring impellers; liquid in the vessel is sufficiently mixed and stirred by preventing the generation of a steady flow of liquid in the vessel; liquid in the vessel is mixed and stirred so as to obtain fine particles of uniform particle size to enhance the quality of the processed liquid; leakage of mixed and stirred liquid to the outside of the vessel is prevented; and lubricant (sealing liquid) for lubricating the rotational shaft is prevented from getting into liquid in the vessel as impurities, so that the deterioration of quality can be prevented.

It is possible to accomplish the above object of the present invention by a stirrer comprising: a vessel including a predetermined number of liquid supply ports into which liquid to be stirred is made to flow, and a liquid exhaust port from which liquid is exhausted after the completion of stirring; a plurality of stirring impellers separately arranged at at least two positions opposed to each other in the vessel, the plurality of stirring impellers being rotated in the directions opposite to each other so that liquid in the vessel can be stirred; external magnets arranged outside the walls of the vessel close to the stirring impellers, the external magnets composing magnet couplings having no penetrating shafts in conjunction with the stirring impellers; and drive means for driving the external magnets so as to rotate the stirring impellers, arranged outside the vessel.

It is also possible to accomplish the above object of the present invention by the above stirrer, wherein one of the stirring impeller and the external magnet connected with each other by means of magnetic coupling is composed of a planar bipolar magnet, the N-pole surface and the S-pole surface of which are arranged in parallel to the rotational axis while the surfaces are put upon each other interposing the rotational axis, and the other of the stirring impeller and the external magnet is composed of a lateral bipolar magnet, the N-pole surface and the S-pole surface of which are arranged on a surface perpendicular to the rotational axis symmetrically to each other with respect to the rotational axis.

According to the above arrangement of the present invention, a plurality of stirring impellers arranged in the vessel opposed to each other respectively generate stirring flows in the vessel, the flowing directions of which are different from each other. Since the stirring flows generated by the respective stirring impellers flow in different directions, they collide with each other, so that stirring can be facilitated in the vessel and a turbulent flow of high speed is generated. Therefore, it is possible to prevent the liquid in the vessel from flowing in a steady state. Even when the stirring impellers are rotated at higher speed, no cavities are formed round the rotational shaft of the stirring impellers, and it is possible to prevent the formation of a steady flow along the inner circumferential surface of the vessel without being sufficiently stirred.

Each stirring impeller arranged in the vessel comprises a magnetic coupling in conjunction with an external magnet arranged outside the vessel close to the stirring impeller. When each external magnet is rotated by a motor located outside the vessel, each stirring impeller is rotated. Due to the above arrangement, it is not necessary for the rotational shaft to penetrate the vessel. Therefore, the vessel can be formed into a closed container structure having no portion through which the rotational shaft is penetrated.

When one of the stirring impeller and the external magnet connected with each other by means of magnetic coupling is composed of a planar bipolar magnet, the N-pole surface and the S-pole surface of which are arranged parallel to the rotational axis while the surfaces are put upon each other interposing the rotational axis, and also when the other of the stirring impeller and the external magnet is composed of a lateral bipolar magnet, the N-pole surface and the S-pole surface of which are arranged on a surface perpendicular to the rotational axis symmetrically to each other with respect to the rotational axis, as compared with a case of a magnetic coupling in which the lateral bipolar magnets are opposed to each other, the joining strength of the coupling is greatly enhanced, so that it is possible to accomplish stirring and mixing at higher rotational speed.

DETAILED DESCRIPTION OF THE PREFERRED EMBODIMENTS

Referring to an embodiment shown in the accompanying drawings, the present invention will be explained below.

Figure 1:
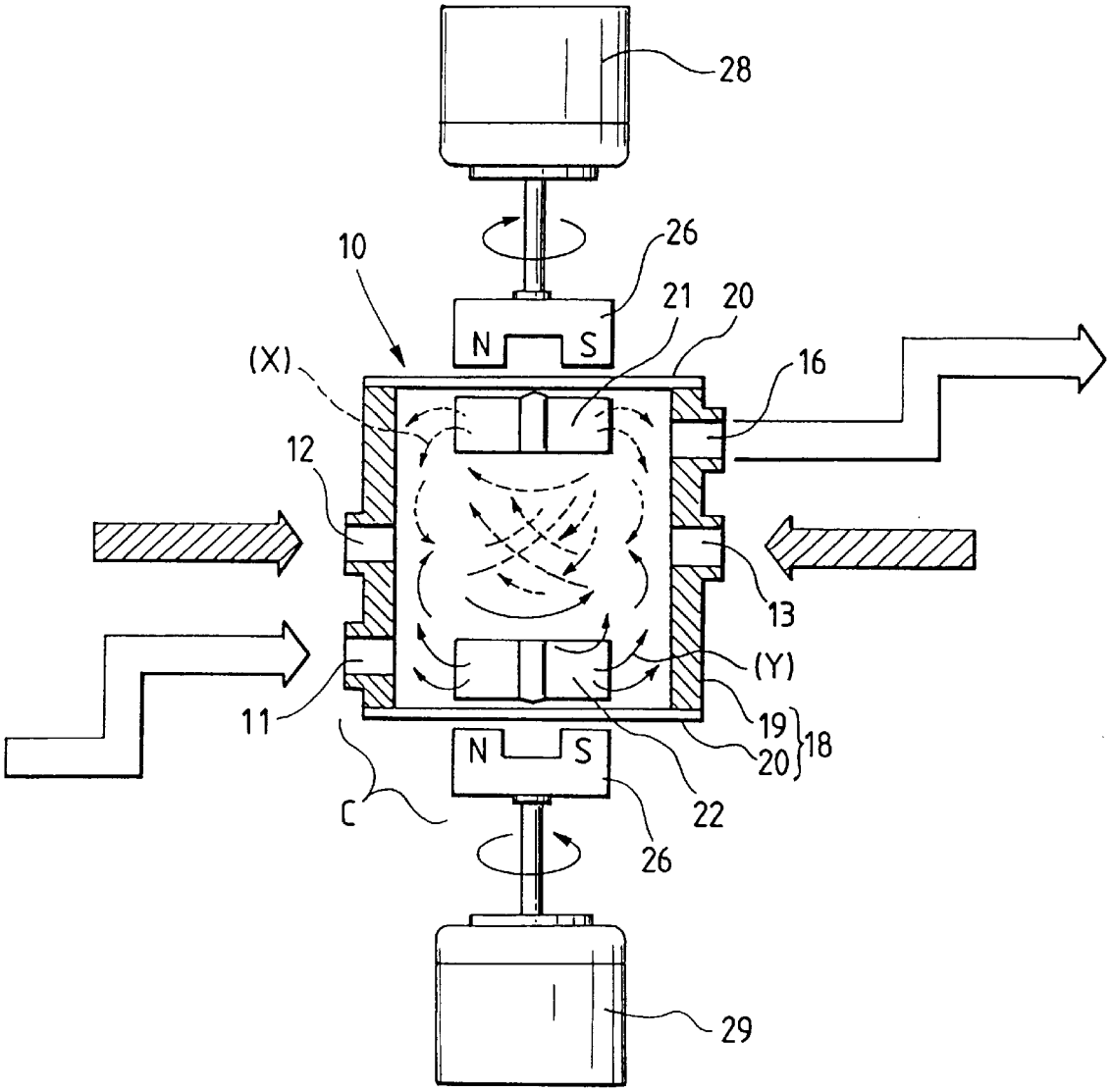
FIG. 1 is a cross-sectional view showing an outline of the stirrer which is an embodiment of the present invention.
Figure 2:
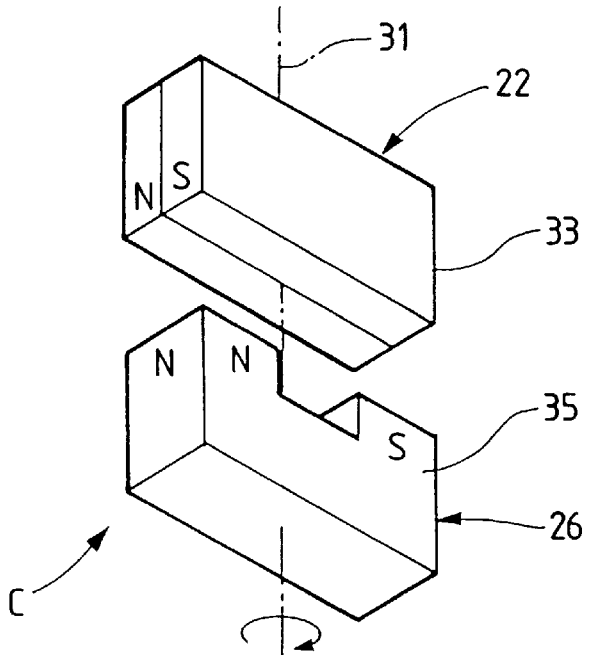
FIG. 2 is a perspective view showing an outline of the structure of the magnetic coupling used for the stirrer which is one embodiment of the present invention.
Figure 3A:
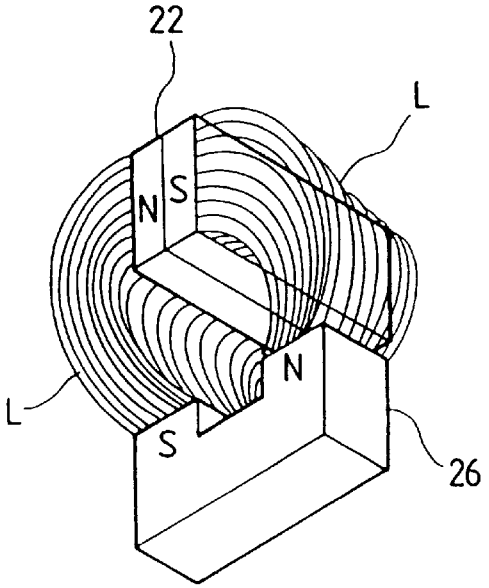
FIGS. 3A and 3B are perspective views showing an action of the magnetic coupling illustrated in FIG. 2.
Figure 3B:
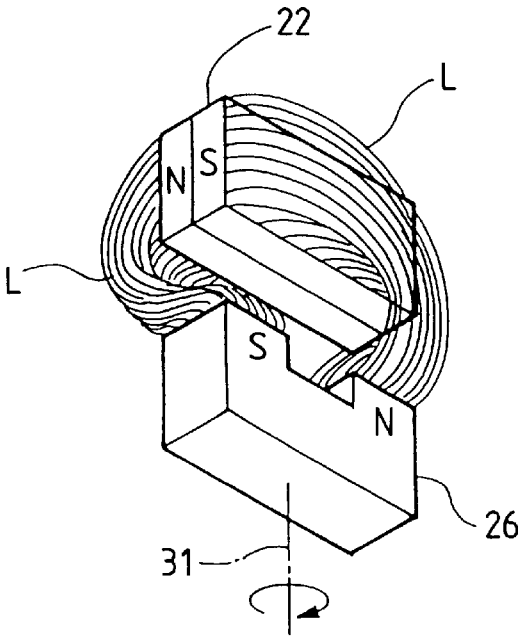
Figure 4:
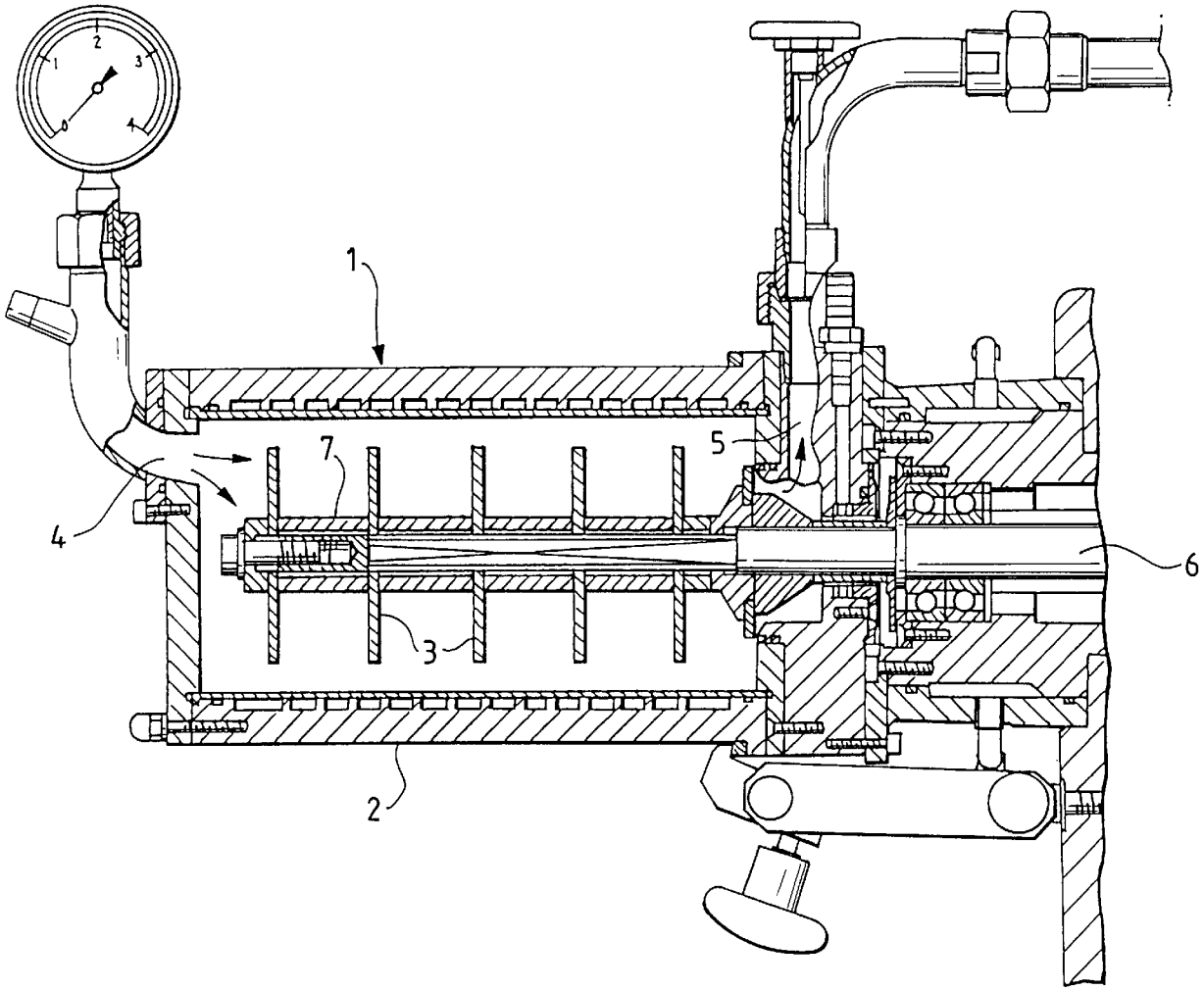
FIG. 4 PRIOR ART
FIG. 4 is a longitudinal cross-sectional view of the conventional stirrer.

FIGS. 1 to 3 are views showing an embodiment of the present invention. FIG. 1 is a cross-sectional view showing an outline of the stirrer which is an embodiment of the present invention. FIG. 2 is a perspective view showing a structure of the magnetic coupling used for the stirrer. FIGS. 3A and 3B are perspective views showing an action of the magnetic coupling illustrated in FIG. 2.

This stirrer 10, which is an embodiment of the present invention, is preferably used in the process of manufacturing photosensitive material when dilution is conducted or stirring and mixing of components of photosensitive material are conducted.

Specifically, the stirrer 10 is composed as illustrated in FIG. 1 as follows. The stirrer 10 includes: a cylindrical vessel 18 having 3 liquid supply ports 11, 12, 13 into which liquid to be stirred is made to flow, and also having a liquid discharge port 16 from which liquid is discharged after it has been stirred; and a pair of stirring impellers 21, 22, which are stirring means for controlling the stirring condition of liquid in the vessel 18 when they are rotated in the vessel 18.

The vessel 18 includes: a cylindrical frame 19, the axis of which is directed in the perpendicular direction; and sealing plates 20 to close the upper and lower end of the cylindrical frame 19. The frame 19 and the sealing plate 20 are made of non-magnetic material having a high permeability.

Three liquid supply ports 11, 12, 13 are arranged at positions close to the lower end of the cylindrical frame 19. The liquid discharge port 16 is arranged at a position close to the upper end of the cylindrical frame 19. In this embodiment, the liquid supply port 11 arranged at the lowermost position of the frame 19 is used for supplying liquid which is a main component to be stirred. The liquid supply ports 12, 13 arranged at the upper positions of the liquid supply port 11 are used for supplying additive liquid to be added into the main liquid so that it can be uniformly stirred and mixed.

A pair of stirring impellers 21, 22 are separately arranged at the upper and the lower end position of the vessel 18 which are opposed to each other. The pair of stirring impellers 21, 22 are rotated in the directions opposite to each other.

Each stirring impeller 21, 22 composes a magnetic coupling C in conjunction with the external magnet 26 arranged outside the vessel (sealing plate 20) which is close to the stirring impeller 21, 22. That is, each stirring impeller 21, 22 is connected with the respective external magnet 26 by a magnetic force. When the magnets 26 are respectively driven and rotated by the independent motors 28, 29, they are rotated in the directions opposite to each other.

FIG. 2 is a view showing a structure of the magnetic coupling C arranged on the lower side of the vessel 18. This magnetic coupling C, which is one embodiment of the invention, includes a stirring impeller 21, 22 composed of a planar bipolar magnet, the N-pole surface and the S-pole surface of which are arranged in parallel to the rotational axis 31 while the surfaces are put upon each other interposing the rotational axis 31. The external magnet 26 is composed of a lateral bipolar magnet (U-shaped magnet) 35, the N-pole surface and the S-pole surface of which are arranged on a surface perpendicular to the rotational axis 31 symmetrically to each other with respect to the rotational axis 31.

In the above magnetic coupling C, lines L of magnetic force are generated between the external magnet 26 and each stirring impeller 21, 22 as illustrated in FIG. 3A. As compared with a magnetic flux generated by a magnetic coupling composed of lateral bipolar magnets, the above magnetic coupling C is characterized in that: the diameter of the magnetic flux connecting the magnets can be doubled; and when the external magnet 26 is rotated, the magnetic flux is bent as illustrated in FIG. 3B, so that a break of the magnetic flux can be prevented, that is, it is possible to provide a magnetic flux viscosity. Accordingly, the coupling strength can be greatly enhanced. Therefore, when a high speed type motor is used as the motor 28, 29, it is possible to rotate the stirring impeller 21, 22 at higher speed.

In the stirrer 10 described above, a pair of stirring impellers 21, 22 opposed to each other in the vessel 18 generate flows of liquid, the directions of which are different from each other. That is, the stirring impeller 21 generates a flow of liquid as illustrated by broken lines (X) in FIG. 1, and the stirring impeller 22 generates a flow of liquid as illustrated by solid lines (Y) in FIG. 1. Directions of the flows of liquid generated by the stirring impellers 21, 22 are different from each other. Therefore, the flows of liquid collide with each other and generate a turbulent flow of high speed in the vessel 18. Accordingly, it is possible to prevent the generation of a steady flow in the vessel 18. Even if the stirring impellers 21, 22 are rotated at high speed, no cavities are formed round the rotational shafts of the stirring impellers 21, 22. As a result, it is possible to solve a problem in which liquid flows along the inner circumferential surface of the vessel 18 and a steady flow is formed without being sufficiently stirred.

Accordingly, when the stirring impellers 21, 22 are rotated at high speed, the processing speed can be easily increased. At this time, no steady flow is formed in the vessel 18, so that it is possible to prevent liquid from being discharged without being sufficiently stirred in the vessel. Accordingly, processing quality can be maintained high by this stirrer.

The stirring impellers 21, 22 arranged in the vessel 18 are respectively connected to the motors 28, 29 arranged outside the vessel 18 via the magnetic couplings C. Accordingly, it is unnecessary that the rotational shafts penetrate the walls of the vessel 18. That is, it is possible to form the vessel 18 into a closed container structure. Consequently, no liquid leaks from the vessel during stirring and mixing, and further lubricant (sealing liquid) for the rotational shaft is not mixed into liquid in the vessel 18 as impurities.

In the magnetic coupling C, the planar bipolar magnet 33 and the lateral bipolar magnet 35 are combined with each other. As compared with a magnetic coupling in which the lateral bipolar magnets 35 are arranged being opposed to each other, the joining strength of the magnetic coupling of the invention can be greatly enhanced. Accordingly, it becomes possible to rotate the stirring impellers 21, 22 at higher speed.

In this connection, the use of the stirrer of the present invention is not limited to the specific example of uniformly stirring and mixing photosensitive material components in the process of manufacturing photosensitive material. It is possible to use the stirrer of the present invention in various industrial fields in which different types of liquid are stirred and mixed with each other.

Liquid to be stirred is not limited to pure liquid, but liquid in which fine solid particles are dispersed may be stirred by the stirrer of the invention.

The stirring action of the stirrer of the present invention is used for not only uniformly mixing liquid components but also facilitating the chemical reaction.

The number of liquid supply ports arranged in the vessel 18 is not limited to the above specific embodiment.

In the above embodiment, the lateral bipolar magnets 35 are used for the external magnets 26, and the planar bipolar magnets 33 are used for the stirring impellers 21, 22. However, even when the planar bipolar magnets 33 are used for the external magnets 26, and also when the lateral bipolar type magnets 35 are used for the stirring impellers 21, 22, the same effects can be provided.

It is possible to use the stirrer of the present invention for manufacturing photosensitive materials. Characteristics of the stirrer of the present invention are described as follows.

(1) When gelatin solution or protective colloid polymer solution, silver salt solution and halogen salt solution are introduced into the stirrer of the present invention, it is possible to-conduct the formation of silver halide particles. In this case, gelatin solution may be introduced into the stirrer as a main flow, and silver salt solution and halogen salt solution may be introduced into the stirrer by means of double jet, however, after gelatin has been dissolved in halogen salt solution, this halogen solution and silver salt solution may be introduced into the stirrer by means of double jet. When this stirrer of the present invention is used for the formation of particles, it is possible to prepare fine particles of very small particle size, and further it is possible to prepare fine particles, the particle size of which is in a monodisperse state, and fine particles, the halogen composition distribution of which is uniform. It is also possible to conduct a twinning core formation.

(2) When emulsion containing silver halide particles, and additive of photographic use (spectral sensitization pigment, chemical sensitizer and so forth) are introduced into the stirrer of the present invention, it is possible that the additive for photographic use is adsorbed by silver halide particles. When this stirrer is used, it is possible that the additive for photographic use is uniformly adsorbed by silver halide particles.

(3) When emulsion containing silver halide particles, halogen salt or silver halide fine particles are introduced into the stirrer of the present invention, the silver halide can be subjected to halogen conversion. When this stirrer is used, it is possible to conduct halogen conversion uniformly on silver halide particles.

(4) When emulsion containing silver halide particles, silver salt solution, halogen salt solution and metal complex solution are introduced into the stirrer of the present invention, the metal complex can be doped by the silver halide particles. In this case, the metal complex may be dissolved in silver salt or halogen salt. When this stirrer is used, the metal complex can be doped uniformly by the silver halide particles.

(5) When gelatin solution (or protective colloid polymer solution), silver salt solution and halogen salt solution are introduced into the stirrer of the present invention, additive for photographic use can be more strongly adsorbed by silver halide when the additive for photographic use is simultaneously introduced. When the additive for photographic use is adsorbed, it is possible to prepare fine particles, the size of which is smaller. When this stirrer is used, the additive for photographic use can be uniformly adsorbed by silver halide particles.

(6) When a plurality of types of additive for photographic use are introduced into the stirrer of the present invention, the additive for photographic use can be mixed. When the stirrer of the present invention is used, the additive for photographic use can be quickly and uniformly mixed.

When the stirrer of the present invention is utilized in the manner described in items (1) to (5), it is possible to utilize a unit of stirrer. However, it is possible to utilize a plurality of units of stirrers, for example, two units of stirrers or three units of stirrers. When the plurality of units of stirrers are utilized, they may be connected with each other in series or parallel. When the plurality of units of stirrers are utilized, it is possible to quickly conduct processing while the aforementioned effects are provided.

Referring to examples, the present invention will be specifically explained as follows. However, it should be noted that the present invention is not limited to the specific examples.

First, the stirrer used in the example will be explained below.

Stirrer 1

(Conventional stirrer)

Figure 5:
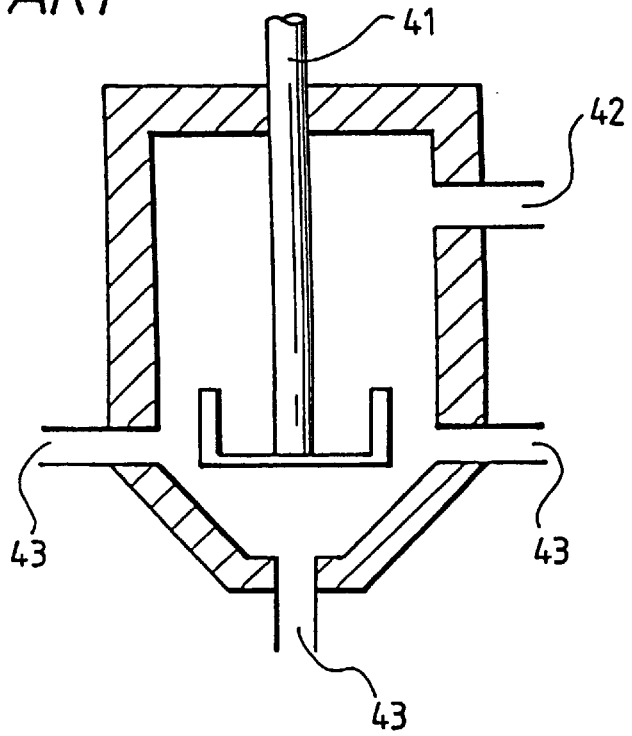
FIG. 5 PRIOR ART
FIG. 5 is a cross-sectional view showing an outline of Stirrer 1 used in the comparative example.

Stirrer 1 is illustrated in FIG. 5 which includes a cylindrical vessel and a stirring impeller rotated in the vessel. The capacity of the vessel is 20 cc.

Stirrer 2

(Example of the present invention)

Figure 6:
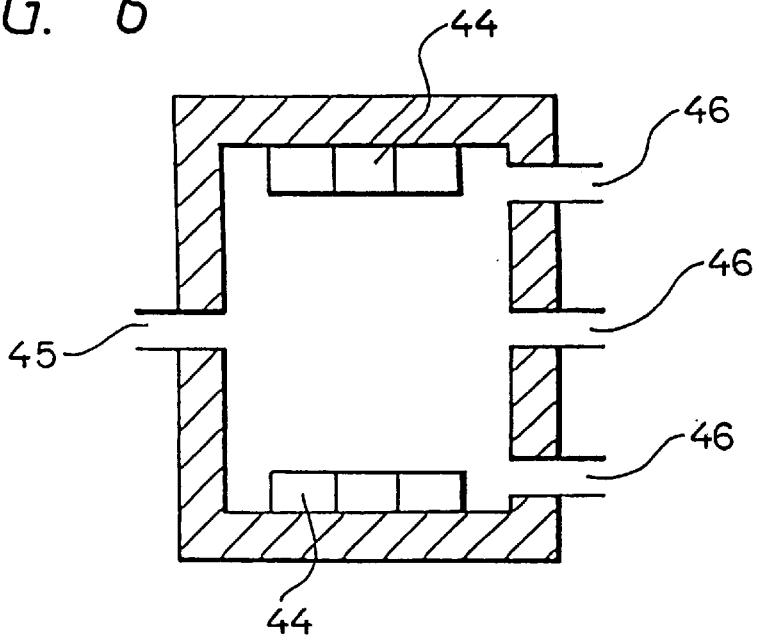
FIG. 6 is a cross-sectional view showing an outline of Stirrer 2 used in the example of the present invention.
Figure 7:
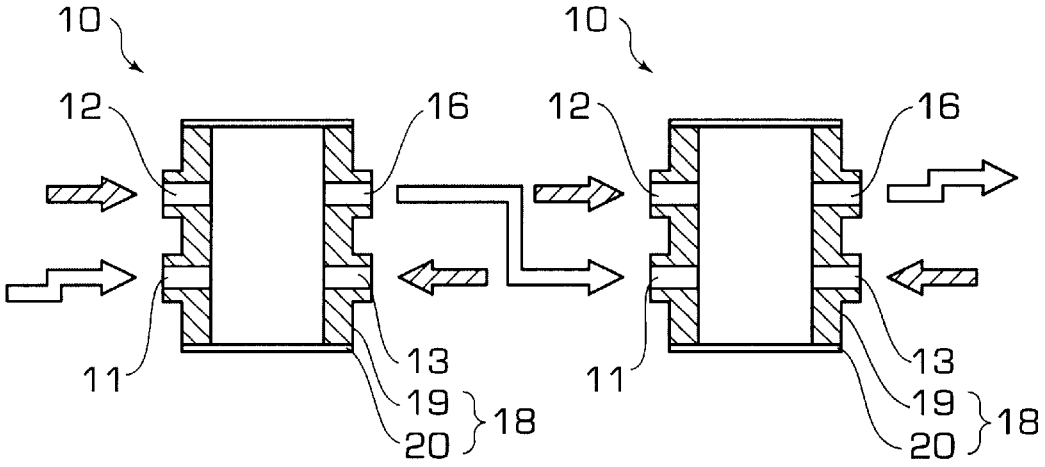
FIG. 7 is a cross-sectional view of two stirrers connected in series.
Figure 8:
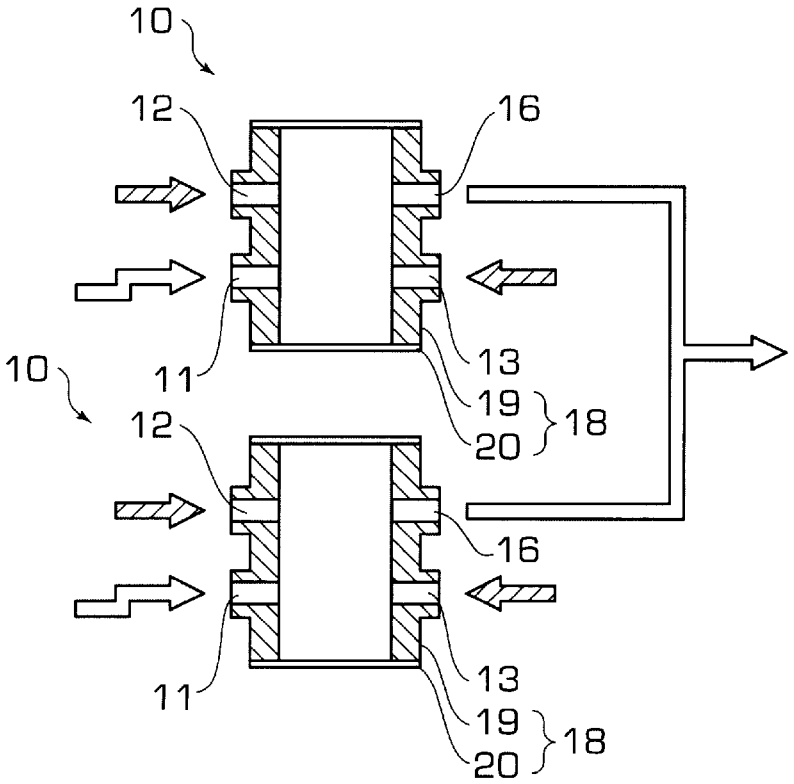
FIG. 8 is a cross-sectional view of two stirrers connected in parallel.
Figure 7A:
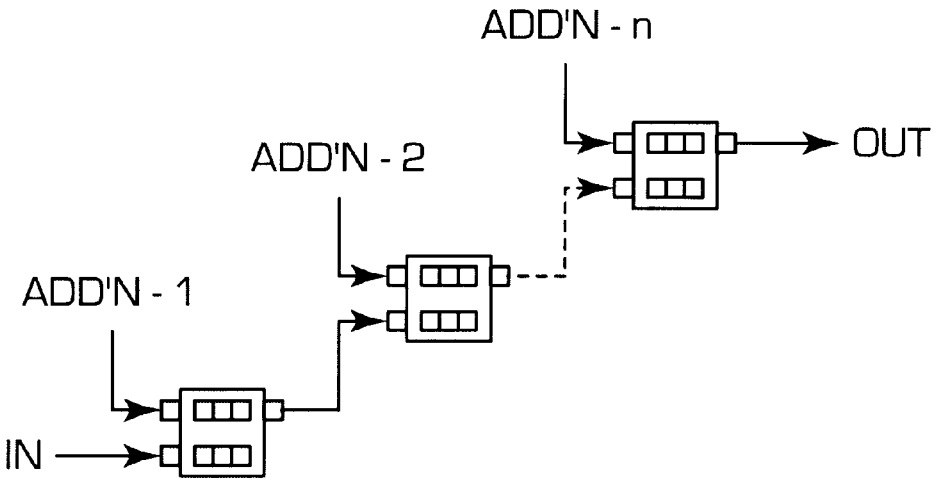
Figure 7B:
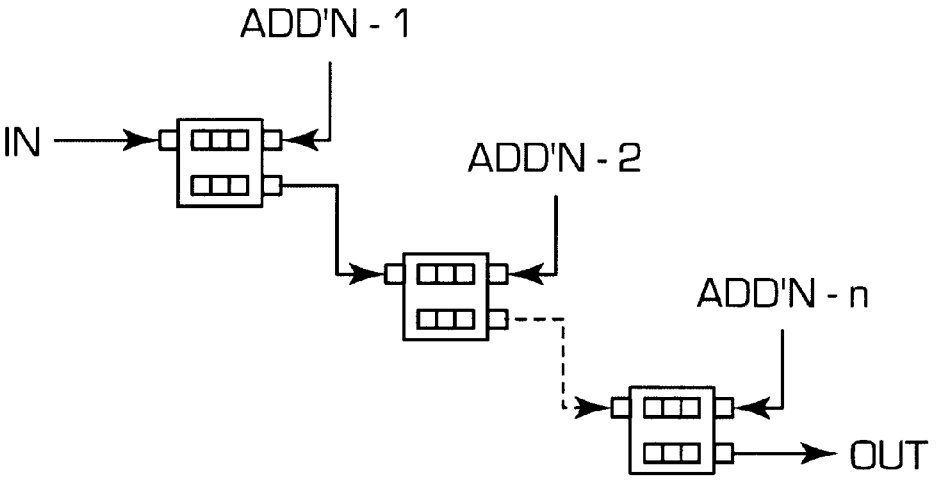
Figure 8A:
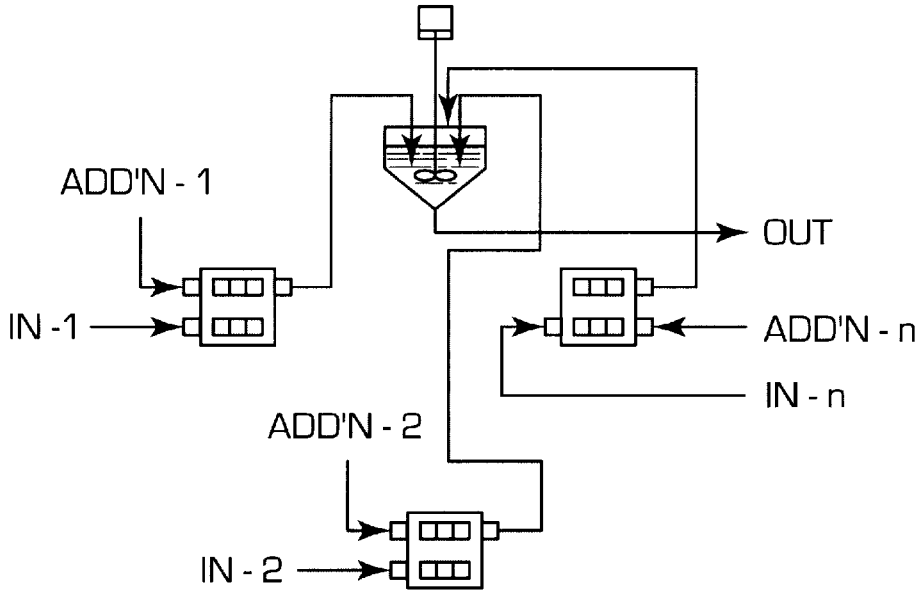
Figure 8B:
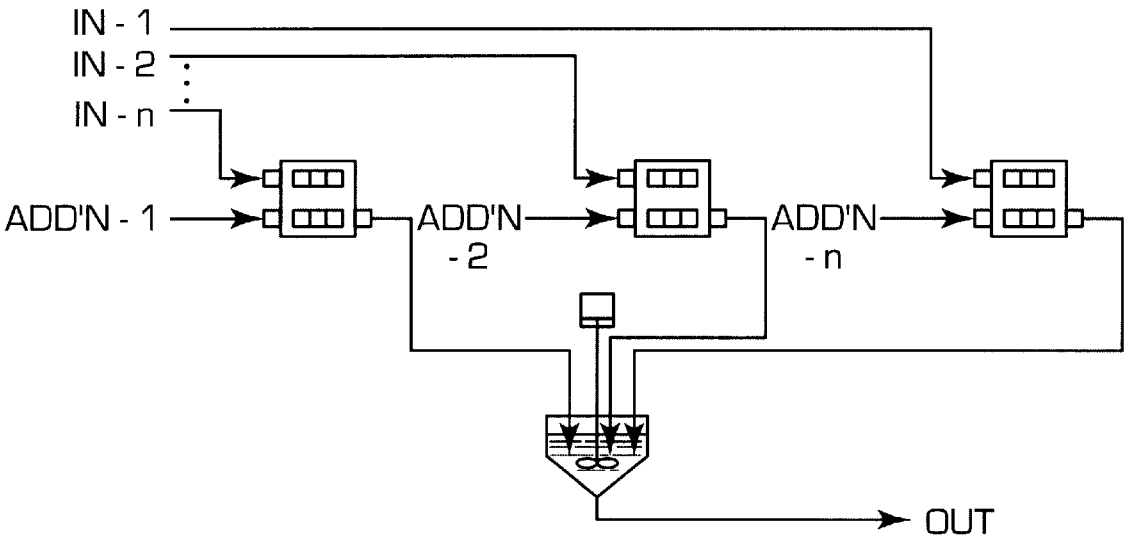
Figure 9:
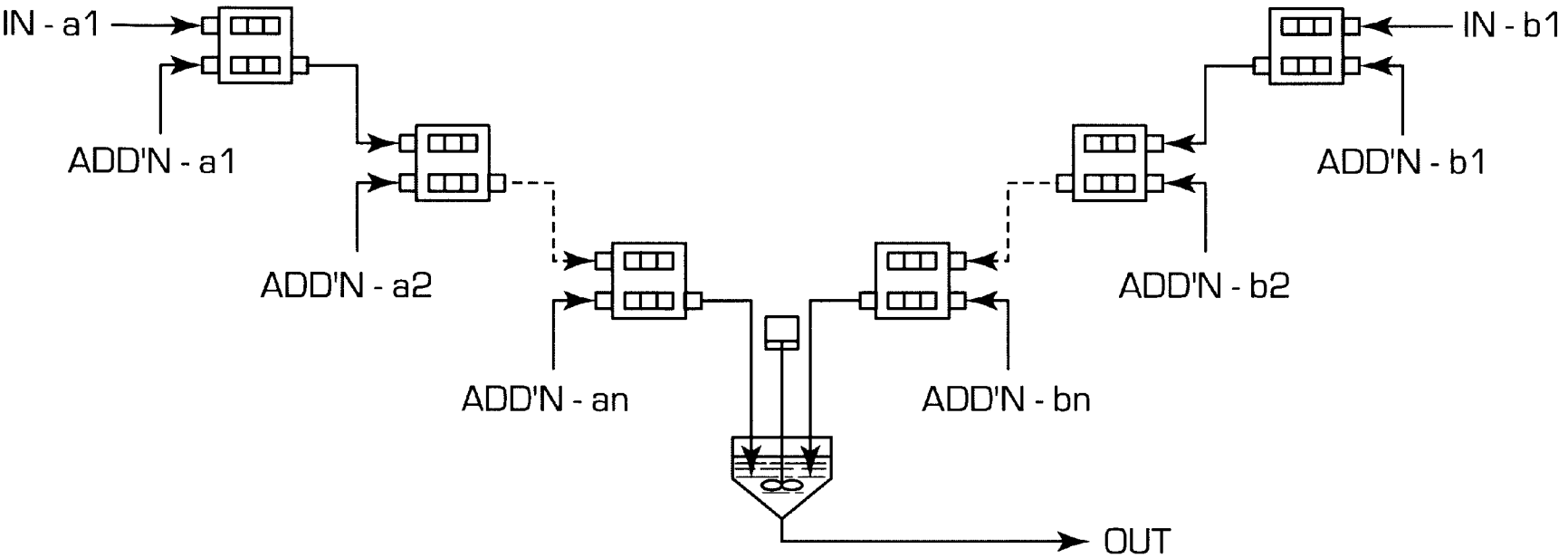

Stirrer 2 is illustrated in FIG. 6 which includes a cylindrical vessel and a pair of stirring impellers 44 arranged at positions separate from each other in the vessel being opposed to each other, wherein the stirring impellers are driven and rotated. In this case, the capacity of the vessel is 8.3 cc.

(Comparative Example 1)

In Stirrer 1, the impeller 41 was rotated at 2000 rpm in the vessel. From one supply port 43 of the vessel, 1 mol/liter of silver nitride solution was fed into the vessel at a rate of 25 cc/min, and from another supply port 43 of the vessel, 0.143 mol/liter of KBr solution, in which gelatin of low molecular weight was dissolved by 2.3%, was fed at a rate of 185 cc/min. Then the thus fed silver nitride solution and gelatin of low molecular weight were mixed and stirred in the vessel, so that silver halide particles were formed. After that, the reaction solution was discharged from one discharge port 42 of the vessel and stored in a reservoir, the temperature of which was previously maintained at 25° C.

The mean size of the thus obtained particles and the size distribution expressed by Coefficient of Variation are shown on Table 1.

(Example 1)

A pair of stirring impellers 44 were rotated at 2000 rpm in Stirrer 2. Supply ports 46 feed the solution into the vessel, and the reaction solution is discharged via discharge port 45. Except for that, other conditions were the same as those of Comparative Example 1, and particle formation was conducted in the same manner. The mean size of the thus obtained particles and the size distribution expressed by Coefficient of Variation are shown on Table 1.

When the stirrer of the present invention was used, it was possible to obtain silver halide particles, the size of which was small and the size distribution of which was narrow.

TABLE 1

| | Mean Size | Coefficient of Variation |
|---|---|---|
| Comparative Example 1 | 0.017 μm | 35% |
| Example 1 of the Invention | 0.014 μm | 24% |

(Comparative Example 2)

In Stirrer 1, the impeller was rotated at 6000 rpm in the vessel. From one supply port of the vessel, 0.8 mol/liter of silver nitride solution was fed into the vessel at a rate of 200 cc/min, and from another supply port of the vessel, 0.5 mol/liter of KBr solution, in which gelatin of low molecular weight was dissolved by 0.87%, was fed at a rate of 338 cc/min, and the thus fed silver nitride solution and gelatin of low molecular weight were mixed and stirred in the vessel, so that silver halide twinning cores were formed. After that, the reaction solution was discharged from one discharge port of the vessel. The reaction solution was added for 7 seconds into a tank in which KBr: 0.19 g and $H_2O$: 1000 cc were stored, the temperature of which was maintained at 65° C. After the completion of addition, the solution was heated to 75° C. for 5 minutes. After 5 minutes, 200 cc of 10% gelatin solution was added. The solution was stirred for 5 minutes, and 105.6 g of silver nitride was added together with KBr solution by means of double jet by an increased flow rate for 15 minutes. At this time, pBr of the dispersion medium was maintained at 2.78.

The thus obtained particles were flat particles of AgBr. The particle size and others are shown on Table 2.

(Example 2)

A pair of stirring impellers were rotated at 6000 rpm in Stirrer 2. Except for that, other conditions were the same as those of Comparative Example 2, and particle formation was conducted in the same manner. The size of the thus obtained particles and others are shown on Table 2.

When the stirrer of the present invention was used, it was possible to obtain silver halide flat particle emulsion in which a ratio of the number of flat particles to the number of all particles was high.

TABLE 2

| | Mean Size | Coefficient of variation | Thickness | Ratio of flat particles |
|---|---|---|---|---|
| Comparative Example 2 | 0.67 μm | 18% | 0.1 μm | 81% |
| Example 2 of the Invention | 0.65 μm | 14% | 0.1 μm | 90% |

(Comparative Example 3)

In Stirrer 1, the temperature was kept at 50° C. and the stirring impeller was rotated at 8000 rpm. From one supply port of the vessel of Stirrer 1, AgBr flat particle emulsion was fed at a flow rate of 100 cc/min, and from another supply port of the vessel of Stirrer 1, solution of cyanin pigment of 0.001 mol/liter was fed at a flow rate of 3.7 cc/min. After emulsion had been taken out from the discharge port, it was stored in a tank and aged at 60° C. for 10 minutes. The thus obtained emulsion was coated on a film support. The thus obtained photographic film was exposed by means of continuous wedge exposure and developed. Performance of the thus processed film is shown on Table 3.

(Example 3)

A pair of stirring impellers were rotated at 8000 rpm in Stirrer 2. Except for that, other conditions were the same as those of Comparative Example 3, with emulsion and solution of cyanin pigment being fed in the same manner. Then the obtained emulsion was coated on a film support. The thus obtained photographic film was exposed and developed. The obtained photographic performance is shown on Table 3.

When the stirrer of the present invention was used, it was possible to obtain an emulsion of high contrast.

TABLE 3

| | Gradation in the case of exposure of minus blue light* |
|---|---|
| Comparative Example 3 | 1.0 |
| Example 3 of the Invention | 1.2 |

*Remark: Gradation of a portion of intermediate density on the characteristic curve shown by a relative value, wherein the gradation of Comparative Example is 1.0.

(Comparative Example 4)

In Stirrer 1, the temperature was kept at 50° C. and the stirring impeller was rotated at 6000 rpm. From one supply port of the vessel of Stirrer 1, AgCl emulsion was fed at a flow rate of 50 cc/min, and from another supply port of the vessel of Stirrer 1, solution of KBr of 0.3 mol/liter was fed at a flow rate of 4.3 cc/min. After emulsion had been taken out from the discharge port, it was stored in a tank and chemical sensitizer was added to it. Then it was aged at 50° C. for 60 minutes. The thus obtained emulsion was coated on a film support. The thus obtained photographic film was exposed by means of continuous wedge exposure and developed. Performance of the thus processed film is shown on Table 4.

(Example 4)

A pair of stirring impellers were rotated at 6000 rpm in Stirrer 2. Except for that, other conditions were the same as those of Comparative Example 4, and emulsion and solution of KBr were added in the same manner. Then the obtained emulsion was coated on a film support. The thus obtained photographic film was exposed and developed. The obtained photographic performance is shown on Table 4.

When the stirrer of the present invention was used, it was possible to obtain an emulsion of high contrast.

TABLE 4

| | Gradation in the case of exposure of blue light* |
|---|---|
| Comparative Example 4 | 1.0 |
| Example 4 of the Invention | 1.15 |

*Remark: Gradation of a portion of intermediate density on the characteristic curve shown by a relative value, wherein the gradation of Comparative Example is 1.0.

(Example 5)

In Example 1, solution of dispersion medium containing silver halide particles, which was made in the stirrer 2 and discharged from the discharge port, was injected into another stirrer 2 through the supply port of the second stirrer 2 and further solution of cyanin pigment was added through another supply port of the second stirrer 2. It was discharged from the discharge port and stored in a tank, the temperature of which was previously maintained at 25° C. The thus obtained particle size is shown on Table 5.

By using two units of stirrer 2, cyanin pigment was adsorbed by particles, and it was possible to obtain particles of small size.

TABLE 5

| | Size |
|---|---|
| Example 1 of the Invention | 0.014 μm |
| Example 5 of the Invention | 0.011 μm |

According to the stirrer of the present invention, a pair of stirring impellers arranged in the vessel being opposed to each other respectively generate flows of liquid, the flowing directions of which are different from each other. Since the directions of flows generated by the respective stirring impellers are different from each other, the flows collide with each other, so that a turbulent flow of high speed can be generated and stirring in the vessel can be facilitated. Accordingly, the generation of a steady flow in the vessel can be prevented. Even when the stirring impellers are rotated at high speed, the generation of cavities round the rotational shafts of the impellers can be prevented, and it is possible to prevent the formation of a steady flow along the inner circumferential surface of the vessel without being sufficiently stirred.

When the rotational speed of the stirring impellers is increased, the processing speed can be easily increased. At this time, the generation of a steady flow in the vessel is prevented, so that liquid can be sufficiently stirred in the vessel, and stirring can be conducted while fine particles of uniform size are produced in liquid. In this way, the deterioration of processing quality can be prevented.

Each stirring impeller arranged in the vessel composes a magnetic coupling in conjunction with an external magnet arranged outside the vessel close to the stirring impeller. When each external magnet is rotated by a motor located outside the vessel, each stirring impeller is rotated. Due to the above arrangement, it is not necessary for the rotational shaft to penetrate the vessel. Therefore, the vessel can be formed into a closed container structure having no portion through which the rotational shaft is penetrated. Accordingly, no liquid leaks outside the vessel while it is being stirred, and lubricant (sealing liquid) used for the rotational shaft is not mixed into the liquid in the vessel as impurities. In this way, the deterioration of processing quality can be prevented.

When one of the stirring impeller and the external magnet connected with each other by means of magnetic coupling is composed of a planar bipolar magnet, the N-pole surface and the S-pole surface of which are arranged parallel to the rotational axis while the surfaces are put upon each other interposing the rotational axis, and also when the other of the stirring impeller and the external magnet is composed of a lateral bipolar magnet, the N-pole surface and the S-pole surface of which are arranged on a surface perpendicular to the rotational axis symmetrically to each other with respect to the rotational axis, as compared with a case of a magnetic coupling in which the lateral bipolar magnets are opposed to each other, the joining strength of the magnetic coupling is greatly enhanced, so that it is possible to accomplish stirring and mixing at higher rotational speed.

It should also be understood that the foregoing relates to only a preferred embodiment of the invention, and that it is intended to cover all changes and modifications of the examples of the invention herein chosen for the purposes of the disclosure, which do not constitute departures from the spirit and scope of the invention.

What is claimed is:

1. A stirring apparatus comprising:

a vessel having walls and upper and lower ends, including:

a predetermined number of liquid supply ports into which liquid to be stirred is made to flow; and a liquid exhaust port from which liquid is exhausted after stirring;

a plurality of stirring impellers separately arranged at said upper and lower ends and opposed to each other within said vessel, said plurality of stirring impellers being rotated in directions opposite to each other so that liquid in said vessel is stirred in opposite directions within said vessel;

external magnets arranged outside the walls of said vessel at said upper and lower ends and opposed to said stirring impellers, said external magnets comprising magnetic couplings having no shafts which penetrate the vessel and are connected to said stirring impellers; and drive means, arranged only outside said vessel, for driving said external magnets so as to rotate said stirring impellers.

2. A stirring apparatus comprising:

a plurality of vessels each having walls and including:

a predetermined number of liquid supply ports into which liquid to be stirred is made to flow; and a liquid exhaust port from which liquid is exhausted after stirring;

a plurality of stirring impellers separately arranged at at least two positions opposed to each other in said vessels, said plurality of stirring impellers being rotated in directions opposite to each other so that liquid in each of said vessels is stirred;

external magnets arranged outside the walls of said vessels close to said stirring impellers, said external magnets comprising magnetic couplings having no shafts which penetrate the vessels and are connected to said stirring impellers; and drive means, arranged outside said vessels, for driving said external magnets so as to rotate said stirring impellers;

wherein said plurality of vessels are coupled in series in a manner such that said liquid exhaust port of one of said vessels is connected to one of said liquid supply ports of another one of said vessels.

3. A stirring apparatus comprising:

a plurality of vessels each having walls and including:

a predetermined number of liquid supply ports into which liquid to be stirred is made to flow; and a liquid exhaust port from which liquid is exhausted after stirring;

a plurality of stirring impellers separately arranged at at least two positions opposed to each other in said vessels, said plurality of stirring impellers being rotated in directions opposite to each other so that liquid in each of said vessels is stirred;

external magnets arranged outside the walls of said vessels close to said stirring impellers, said external magnets comprising magnetic couplings having no shafts penetrating said vessels and connected to said stirring impellers; and drive means, arranged outside said vessels, for driving said external magnets so as to rotate said stirring impellers;

wherein said plurality of vessels are coupled in parallel in a manner such that all the liquid exhaust ports of said vessels are connected into a single liquid discharge port.

4. The stirring apparatus of claim 1, 2, or 3, wherein:

one of said stirring impellers and said external magnets connected with each other by means of one of said magnetic couplings is composed of a planar bipolar magnet, a N-pole surface and a S-pole surface of which are arranged in parallel to a rotational axis of said one of said magnetic couplings while said N-pole surface and said S-pole surface are disposed next to each other, the rotational axis being interposed between said N-pole surface and said S-pole surface; and the other of the stirring impellers and the external magnets is composed of a lateral bipolar magnet, an N-pole surface and an S-pole surface of which are arranged on a surface perpendicular to the rotational axis, and disposed symmetrically to each other with respect to the rotational axis.

* * * * *